US010236579B2

(12) United States Patent
An et al.

(10) Patent No.: US 10,236,579 B2
(45) Date of Patent: Mar. 19, 2019

(54) DUAL-BAND DUAL-PORT ANTENNA STRUCTURE

(71) Applicants: Delta Electronics, Inc., Taoyuan (TW); Nanyang Technological University, Singapore (SG)

(72) Inventors: Wenxing An, Singapore (SG); Zhongxiang Shen, Singapore (SG); Peijung Chung, Taoyuan (TW); Fangming Wu, Taoyuan (TW)

(73) Assignees: DELTA ELECTRONICS, INC., Taoyuan (TW); NANYANG TECHNOLOGY UNIVERSITY, Singapore (SG)

( * ) Notice: Subject to any disclaimer, the term of this patent is extended or adjusted under 35 U.S.C. 154(b) by 204 days.

(21) Appl. No.: 15/343,321

(22) Filed: Nov. 4, 2016

(65) Prior Publication Data

US 2018/0123244 A1 May 3, 2018

(30) Foreign Application Priority Data

Oct. 31, 2016 (SG) ..... 10201609104U

(51) Int. Cl.

| | |
|---|---|
| ***H01Q 1/48*** | (2006.01) |
| ***H01Q 5/392*** | (2015.01) |
| ***H01Q 1/36*** | (2006.01) |
| ***H01Q 1/52*** | (2006.01) |
| ***H01Q 9/28*** | (2006.01) |
| ***H01Q 9/42*** | (2006.01) |

(Continued)

(52) U.S. Cl.

CPC ..... *H01Q 5/392* (2015.01); *H01Q 1/36* (2013.01); *H01Q 1/521* (2013.01); *H01Q 5/321* (2015.01); *H01Q 5/40* (2015.01); *H01Q 9/285* (2013.01); *H01Q 9/42* (2013.01); *H01Q 1/48* (2013.01)

(58) Field of Classification Search

CPC ..... H01Q 1/38; H01Q 1/243

See application file for complete search history.

(56) References Cited

U.S. PATENT DOCUMENTS 7,084,831 B2 8/2006 Takagi et al.
2013/0293249 A1* 11/2013 Han ..... G01R 1/045 324/750.02

(Continued)

FOREIGN PATENT DOCUMENTS

WO WO2015/100642 A1 7/2015

*Primary Examiner* — Dameon E Levi
*Assistant Examiner* — David E Lotter
(74) *Attorney, Agent, or Firm* — Muncy, Geissler, Olds & Lowe, P.C.

(57) ABSTRACT

A dual-band dual-port antenna structure is provided. The dual-band dual-port antenna structure includes a first antenna structure and a second antenna structure. The first antenna structure operates in a high-frequency band and includes a first feeding port, a first feeding path electrically connected to the first feeding port, and a first radiating element. The second antenna structure operates in a low-frequency band and includes a second feeding port, a second feeding path electrically connected to the second feeding port, and a second radiating element. The first feeding path includes a first capacitor and a first feeding line. The second radiating element of the second antenna structure at least partially surrounds the first radiating element of the first antenna structure.

16 Claims, 12 Drawing Sheets

(51) Int. Cl.
*H01Q 5/321* (2015.01)
*H01Q 5/40* (2015.01)

(56) References Cited

U.S. PATENT DOCUMENTS

| | | | | |
|---|---|---|---|---|
| 2015/0029071 | A1* | 1/2015 | Hwang | H01Q 5/35 343/845 |
| 2016/0285167 | A1* | 9/2016 | Tsai | H01Q 13/106 |
| 2016/0294062 | A1* | 10/2016 | Lo Hine Tong | H01Q 1/2291 |

* cited by examiner

DUAL-BAND DUAL-PORT ANTENNA STRUCTURE

CROSS REFERENCE TO RELATED APPLICATION

The present application is based on, and claims priority from, Singapore Application Number 10201609104U, filed on Oct. 31, 2016, the invention of which is hereby incorporated by reference herein in its entirety.

TECHNICAL FIELD

The invention relates to a dual-band dual-port antenna structure, and more particularly to the dual-band dual-port antenna structure applying passive loading.

BACKGROUND

In current antenna designs, three improvement methods are used in the dual-band dual-port antenna structure for reducing mutual coupling between the low-band part and the high-band part of the dual-band dual-port antenna structure. The first improvement method is increasing the distance between the low-band part and the high-band part and it is a conventional means of reducing mutual coupling. It is easy to understand that the wider the distance between two parts, the smaller the mutual coupling that can be obtained. The disadvantage is clear because it would cause the antenna structure to be less compact and space-consuming. The second improvement method is employing a decoupling structure between the low-band part and high-band part of the dual-band dual-port antenna structure. The decoupling structure in the second improvement method includes shorting the post/strip/patch, the decoupling networks, the electromagnetic band-gap (EBG) structure, and so on. This technique can improve the mutual coupling in a relatively small space compared with the first method, but it still needs a certain structure between the low-band and high-band parts, which makes the total structure relatively complicated. Moreover, such techniques are usually narrow-banded. The third improved method is orthogonal polarization. The third improvement method makes the polarization of two bands orthogonal with each other, which is an effective way to decrease the mutual coupling. However, this method is special and it cannot meet the requirements on systems where the same polarization at both bands is required.

SUMMARY

To overcome the drawbacks of the prior art, embodiments of the present invention provide dual-band dual-port antenna structures, at a size that makes it applicable for use in a variety of mobile devices. In one exemplary embodiment, the disclosure is directed to a dual-band dual-port antenna structure. The dual-band dual-port antenna structure includes a first antenna structure and a second antenna structure. The first antenna structure operates in a high-frequency band and includes a first feeding port, a first feeding path electrically connected to the first feeding port, and a first radiating element. The second antenna structure operates in a low-frequency band and includes a second feeding port, a second feeding path electrically connected to the second feeding port, and a second radiating element. The first feeding path includes a first capacitor and a first feeding line. The second radiating element of the second antenna structure at least partially surrounds the first radiating element of the first antenna structure.

Another embodiment of the present invention provides a dual-band dual-port antenna structure. The dual-band dual-port antenna structure includes a first antenna structure and a second antenna structure. The first antenna structure operates in a high-frequency band and includes a first feeding port, a first feeding path electrically connected to the first feeding port, and a first radiating element. The second antenna structure operates in a low-frequency band and includes a second feeding port, a second feeding path electrically connected to the second feeding port, and a second radiating element. The first feeding path includes a first capacitor and a first feeding line. The second radiating element includes a first radiating branch and a second radiating branch. The first radiating branch includes a first inductor and the second radiating branch includes a second inductor. The second radiating element of the second antenna structure at least partially surrounds the first radiating element of the first antenna structure.

BRIEF DESCRIPTION OF THE DRAWINGS

The present invention can be more fully understood by reading the subsequent detailed description and examples with references made to the accompanying drawings, wherein.

DETAILED DESCRIPTION

The following description is of the best-contemplated mode of carrying out the present invention. This description is made for the purpose of illustrating the general principles of the present invention and should not be taken in a limiting sense. The scope of the present invention is best determined by reference to the appended claims.

Figure 1:
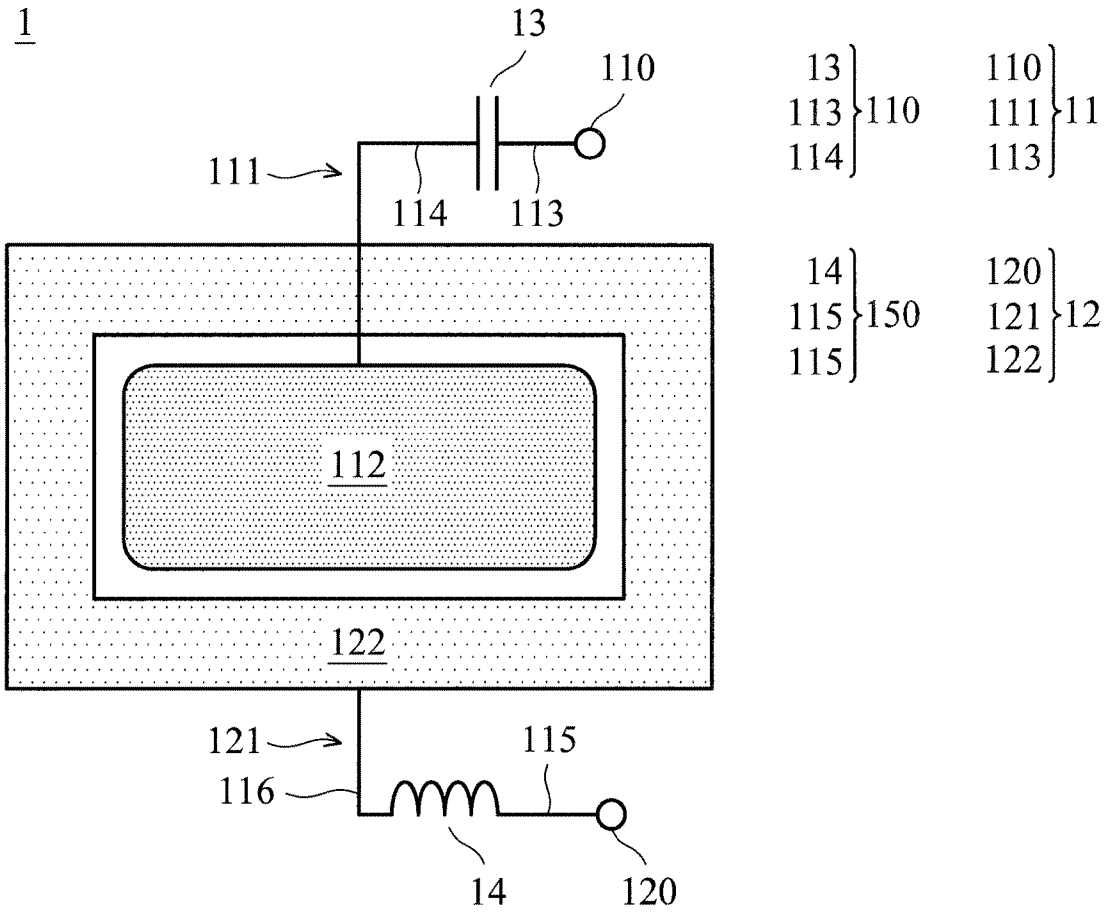
FIG. 1 is a schematic diagram showing a dual-band dual-port antenna structure 1 according to an embodiment of the present disclosure.

FIG. 1 is a schematic diagram showing a dual-band dual-port antenna structure 1 according to an embodiment of the present disclosure. In the embodiment of the present invention, the dual-band dual-port antenna structure 1 includes a high-frequency antenna 11 and a low-frequency antenna 12. The high-frequency antenna 11 can be an ultra-wideband (UWB) antenna, and the low-frequency antenna 12 can be an ultra-high-frequency (UHF) antenna. The high-frequency antenna 11 includes a first feeding port 110, a first feeding path 111 and a high-frequency antenna structure 112. The low-frequency antenna 12 includes a second feeding port 120, a second feeding path 121 and a low-frequency antenna structure 122. The first feeding port 110 and the second feeding port 120 are respectively electrically connected to the first feeding path 111 and the second feeding path 121. The first feeding path 111 includes a transmission line 113, a transmission line 114 and a capacitor 13. Signals received from the first feeding port 110 feed into the high-frequency antenna structure 112 through the first feeding path 111. The second feeding path 121 includes a transmission line 115, a transmission line 116 and an inductor 14. Signals received from the second feeding port 120 feed into the low-frequency antenna structure 122 through the second feeding path 121.

In the embodiment of the present invention, the high-frequency antenna structure 112 of the high-frequency antenna 11 is excited to generate a high-frequency band, the low-frequency antenna structure 122 of the low-frequency antenna 12 is excited to generate a low-frequency band, the high-frequency band is substantially from 3 GHz to 5 GHz, and the low-frequency band is substantially from 880 MHz to 920 MHz. Accordingly, the capacitance of the capacitor 13 is selected as 2 pF and an inductance of the inductor 14 is selected as 6 nH, wherein reactance of the capacitor 13 and the inductor 14 with different operation frequencies are represented in Table 1 and Table 2 shown below:

TABLE 1

| | when the capacitance of the capacitor 13 is selected as 2 pF | | | |
|---|---|---|---|---|
| frequencies | 900 MHz | 3 GHz | 4 GHz | 5 GHz |
| reactance | 88.4 | 26.5 | 19.9 | 15.9 |

TABLE 2

| | when the inductance of the inductor 14 is selected as 6 nH | | | |
|---|---|---|---|---|
| frequencies | 900 MHz | 3 GHz | 4 GHz | 5 GHz |
| reactance | 33.9 | 113.1 | 150.8 | 188.5 |

In this embodiment of the present invention, through the above selected capacitance and inductance, the capacitor 13 can be used as a short circuit in the high-frequency band (3 GHz~5 GHz) and used as an open circuit in the low-frequency band (880 MHz~920 MHz), and the inductor 14 can be used as the open circuit in the high-frequency band (3 GHz~5 GHz) and used as the short circuit in the low-frequency band (880 MHz~920 MHz). Hence, the capacitor 13 can be used as a high pass filter for reducing the effect that the low-frequency antenna 12 has on the low-frequency antenna structure 122 caused by input signals fed from the first feeding port 110 of the high-frequency antenna 11. Similarity, the inductor 14 can be used as a low pass filter for reducing the effect that the high-frequency antenna 11 has on the high-frequency antenna structure 112 caused by input signals fed from the second feeding port 120 of the low-frequency antenna 12. Since the capacitor 13 and the inductor 14 effectively reduce mutual coupling between the high-frequency antenna 11 and the low-frequency antenna 12, increasing the distance between the high-frequency antenna 11 and the low-frequency antenna 12 is not required, so the high-frequency antenna 11 and the low-frequency antenna 12 can be designed to be more compact. As shown in FIG. 1, the low-frequency antenna 12 entirely surrounds the high-frequency antenna 11, and the high-frequency antenna 11 and the low-frequency antenna 12 are designed in a common space. But the present disclosure is not limited thereto. In another embodiment of the present invention, the low-frequency antenna 12 substantially surrounds the high-frequency antenna 11, i.e. the low-frequency antenna 12 partially surrounds the high-frequency antenna 11.

Figure 2A:
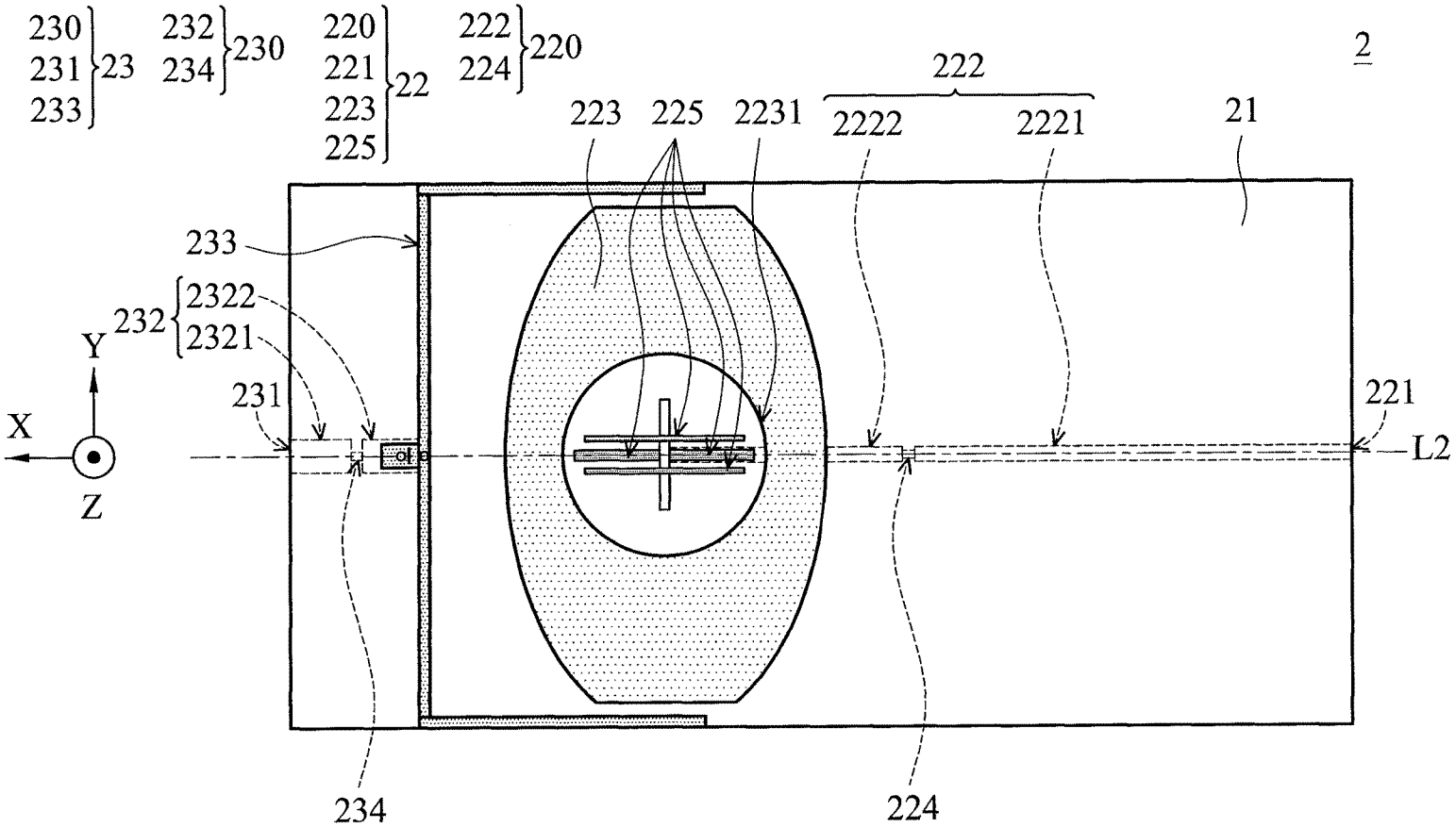
FIG. 2A is a top-view diagram showing a dual-band dual-port antenna structure 2 according to another embodiment of the present disclosure.
Figure 2B:
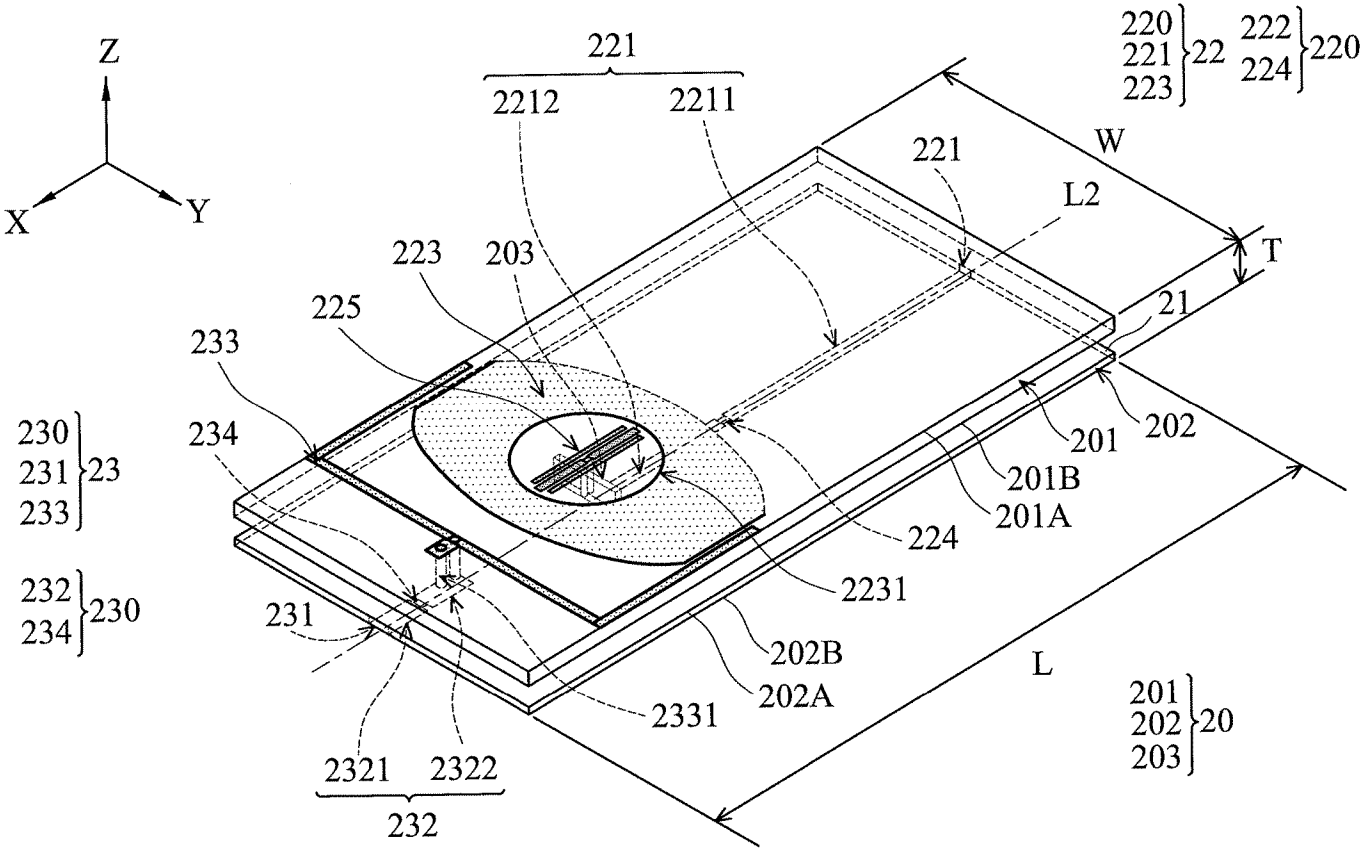
FIG. 2B is a 3D (three-dimensional) diagram showing the dual-band dual-port antenna structure 2 according to another embodiment of the present disclosure.

FIG. 2A and FIG. 2B are schematic diagrams of a dual-band dual-port antenna structure 2 according to an embodiment of the present disclosure. FIG. 2A is a top-view diagram showing the dual-band dual-port antenna structure 2 and FIG. 2B is a 3D diagram showing the dual-band dual-port antenna structure 2.

As shown in FIG. 2A and FIG. 2B, the dual-band dual-port antenna structure 2 of the present embodiment includes a first antenna structure 22 and a second antenna structure 23. The first antenna structure 22 is operated in a high-frequency band and the second antenna structure 23 is operated in a low-frequency band. The first antenna structure 22 includes a first radiating element 223 disposed on a first plane, a first feeding port 221 and a first feeding path 220 disposed on a second plane, wherein the first plane and the second plane are not coplanar. The second antenna structure 23 includes a second radiating element 233 disposed on the first plane, and a second feeding port 231 and a second feeding path 230 disposed on the second plane. The first feeding path 220 includes a first feeding line 222 and a capacitor 224 and the second feeding path 230 includes a second feeding line 232 and an inductor 234. The first feeding port 221 and the second feeding port 231 are respectively connected to the first feeding path 220 and the second feeding path 230 such that signals received from the first feeding port 221 and the second feeding port 231 are respectively fed into the first radiating element 223 and the second radiating element 233 through the first feeding path 220 and the second feeding path 230.

As shown in FIG. 2B, the dual-band dual-port antenna structure 2 further includes a first substrate 201, a second substrate 202, a third substrate 203 and a ground plane 21. The first radiating element 223 and the second radiating element 233 are disposed on a front side 201A (which faces +Z direction of the first plane) of the first substrate 201. The ground plane 21 is disposed on a front side (which faces +Z direction) 202A of the second substrate 202 and electrically connected to ground. The first feeding path 220 and the second feeding path 230 are disposed on a reverse side 202B (which faces −Z direction of the second plane) of the second substrate 202. The first substrate 201 is parallel to the second substrate 202. The third substrate 203 is disposed between the first substrate 201 and the second substrate 202 through the front/reverse side of the third substrate 203 being vertical to the front sides of the first substrate 201 and the second substrate 202. The first to third substrates 201~203 can be FR4 (Flame Retardant 4) substrates.

In the embodiment of the present invention, the dual-band dual-port antenna structure 2 is designed in a space of length L, width W and thickness T with 100 mm, 50 mm and 5 mm, wherein the length L and the width W of the first substrate 201 and the second substrate 202 are both 100 mm and 50 mm. The first antenna structure 22 is the UWB antenna and the second antenna structure 23 is the UHF antenna. The first antenna structure 22 and the second antenna structure 23 both have a perpendicular polarization orientation. The high-frequency band is substantially from 3 GHz to 5 GHz, and the low-frequency band is substantially from 880 MHz to 920 MHz.

In the embodiment of the present invention, the first feeding port 221 and the second feeding port 231 are respectively disposed at two sides of the second substrate 202 such that the dual-band dual-port antenna structure 2 is symmetrical to a straight line L2 between the first feeding port 221 and the second feeding port 231. More specifically, the first feeding path 220 and the second feeding path 230 are separately disposed along the straight line L2, the shape of the first radiating element 223 and the shape of the second radiating element 233 are respectively symmetrical to the straight line L2, and the first feeding port 221 and the second feeding port 231 are respectively disposed on two opposite ends of the straight line L2. The second radiating element 233 of the second antenna structure 23 can entirely surround the first radiating element 223 or partially surround the first radiating element 223. In this embodiment, the second radiating element 233 partially surrounds the first radiating element 223 and substantially has a U-shape. An opening of the U-shape faces the second feeding port 231. In this embodiment, an area inside an opening of the U-shape where the first radiating element 233 is located is larger than an area outside the opening of the U-shape where the first radiating element 233 is located. But the present disclosure is not limited thereto. In another embodiment of the present invention, the first radiating element 223 of the first antenna structure 22 is located in the second radiating element 233 of the second antenna structure 23, i.e. the first radiating element 223 is located in the opening of the U-shape of the second radiating element 233.

In the embodiment of the present invention, the first feeding path 220 including the first feeding line 222 and the capacitor 224 is disposed between the first feeding port 221 and the first radiating element 223 and disposed on the reverse side of the second substrate 202. More specifically, the first feeding line 222 has a first feeding portion 2221 and a second feeding portion 2222, the first capacitor 224 is electrically connected between the first feeding portion 2221 and the second feeding portion 2222, and the first feeding portion 2221 is electrically connected between the first feeding port 221 and the first capacitor 224. The first antenna structure 22 further includes a feeding metal element 225. The feeding metal element 225 is electrically connected to the second feeding portion 2222. The feeding metal element 225 is a feeding strip; but the present disclosure is not limited thereto. The first radiating element 223 has an aperture 2231 in the center of the first radiating element 223. Thus the first radiating element 223 is substantially a ring structure. The feeding metal element 225 is located in the aperture 2231 of the first radiating element 223. More specifically, the feeding metal element 225 extends, from an end of the second feeding portion 2222, upwardly into the aperture 2231 of the first radiating element 223. In this embodiment, the first radiating element 223 of the first antenna structure 22 is excited by the feeding metal element 225 of the first antenna structure 22 through electromagnetic coupling.

In the embodiment of the present invention, the second feeding path 230 including the second feeding line 232 and the inductor 234 is disposed between the second feeding port 231 and the second radiating element 233 and disposed on the reverse side of the second substrate 202. More specifically, the second feeding line 232 has a third feeding portion 2321 and a fourth feeding portion 2322, the first inductor 234 is electrically connected between the third feeding portion 2321 and the fourth feeding portion 2322, and the third feeding portion 2321 is electrically connected between the second feeding port 231 and the first inductor 234. The second radiating element 233 further includes a shorting portion 2331. The shorting portion 2331 is electrically connected to ground 21. The shorting portion 2331 is a shorting pin; but the present disclosure is not limited thereto. In this embodiment, the capacitor 224 of the first antenna structure 22 and the inductor 234 of the second antenna structure 23 are both surface mounted components (SMD). The sizes of the SMDs are far less than the space of the dual-band dual-port antenna structure 2. Accordingly, increasing the design space of the dual-band dual-port antenna structure 2 for disposing the capacitor 224 and the inductor 234 is not required.

Figure 3A:
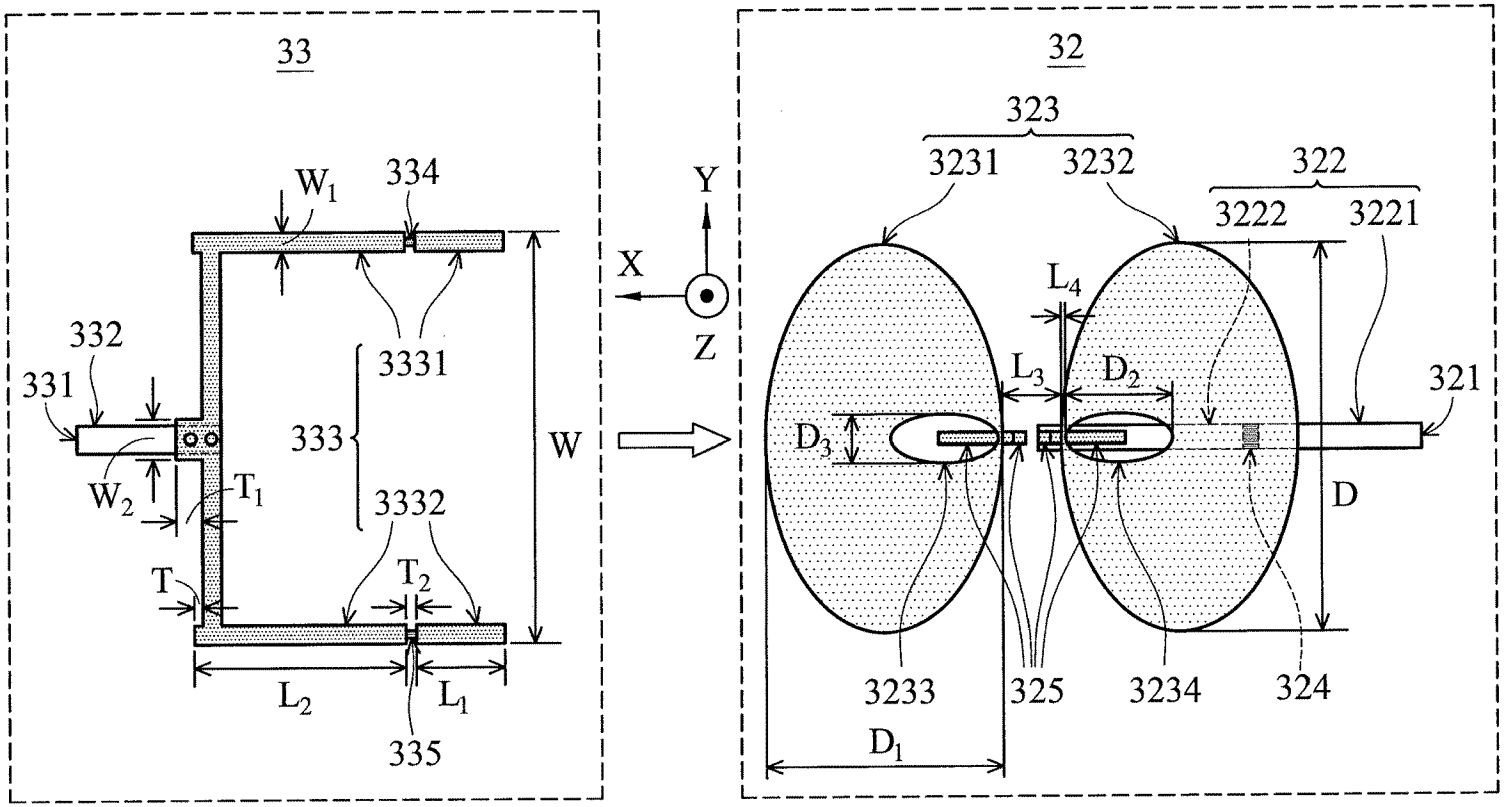
FIG. 3A is a top-view diagram showing a dual-band dual-port antenna structure 3 according to another embodiment of the present disclosure.
Figure 3B:
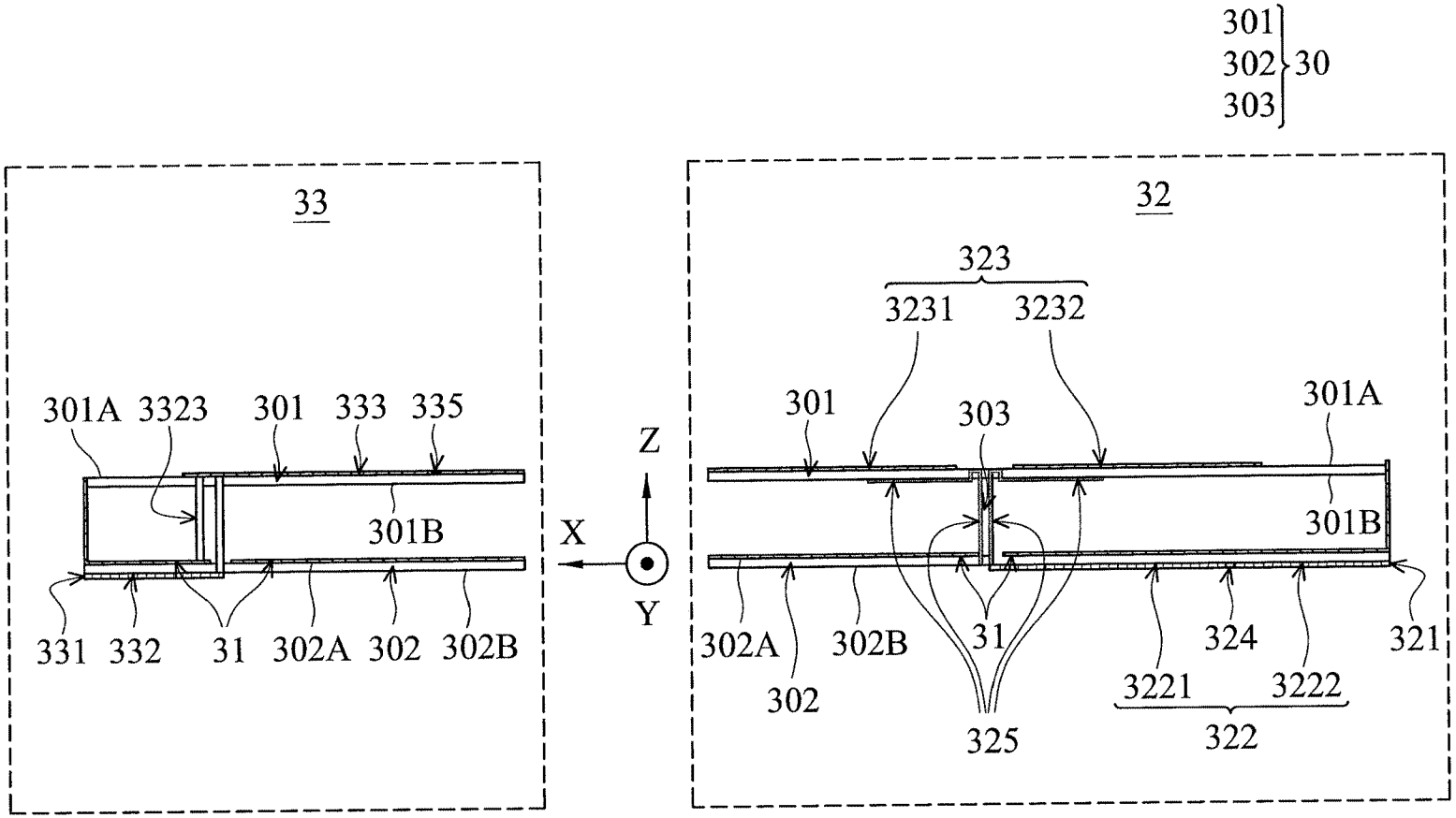
FIG. 3B is a side-view diagram showing the dual-band dual-port antenna structure 3 according to another embodiment of the present disclosure.
Figure 3C:
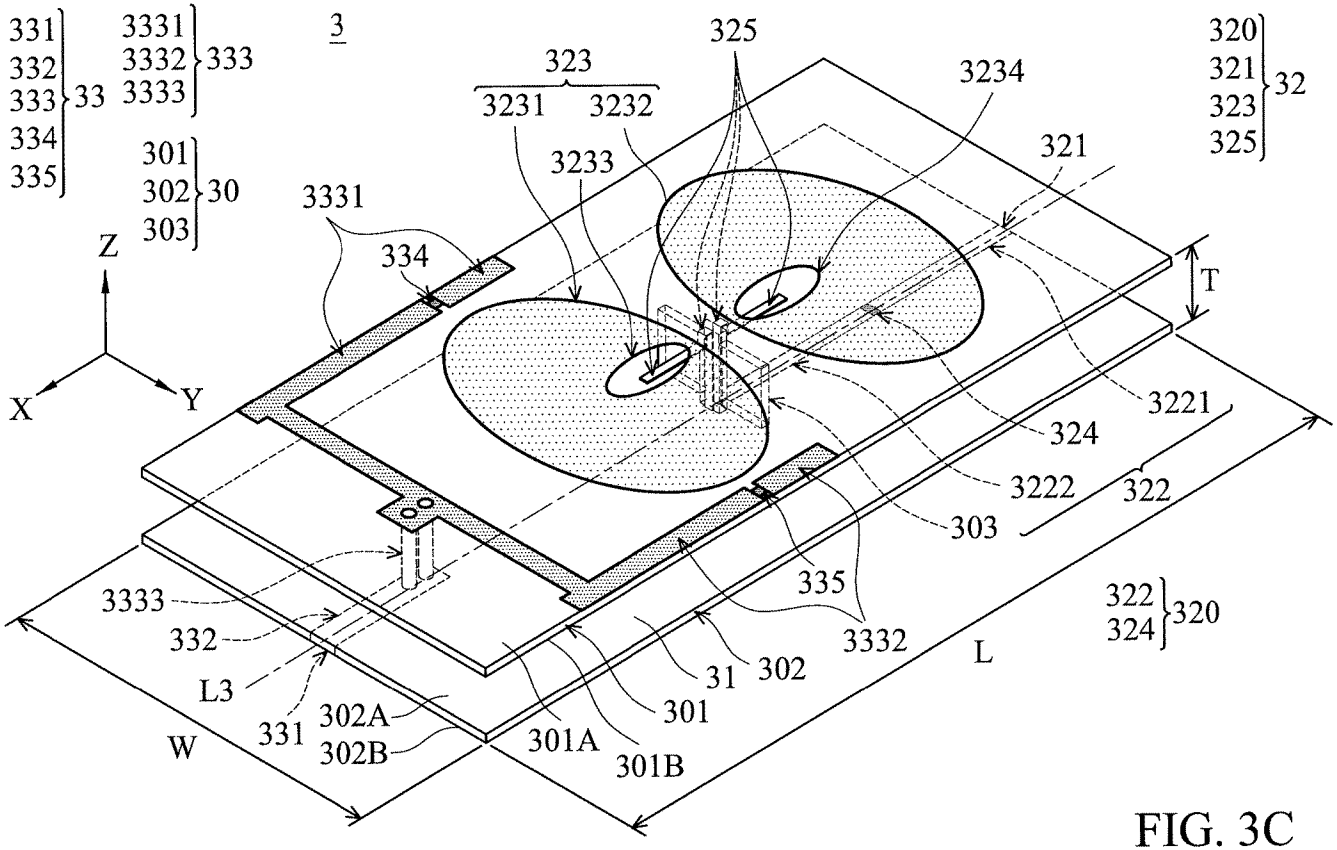
FIG. 3C is a 3D diagram showing the dual-band dual-port antenna structure 3 according to another embodiment of the present disclosure.
Figure 3D:
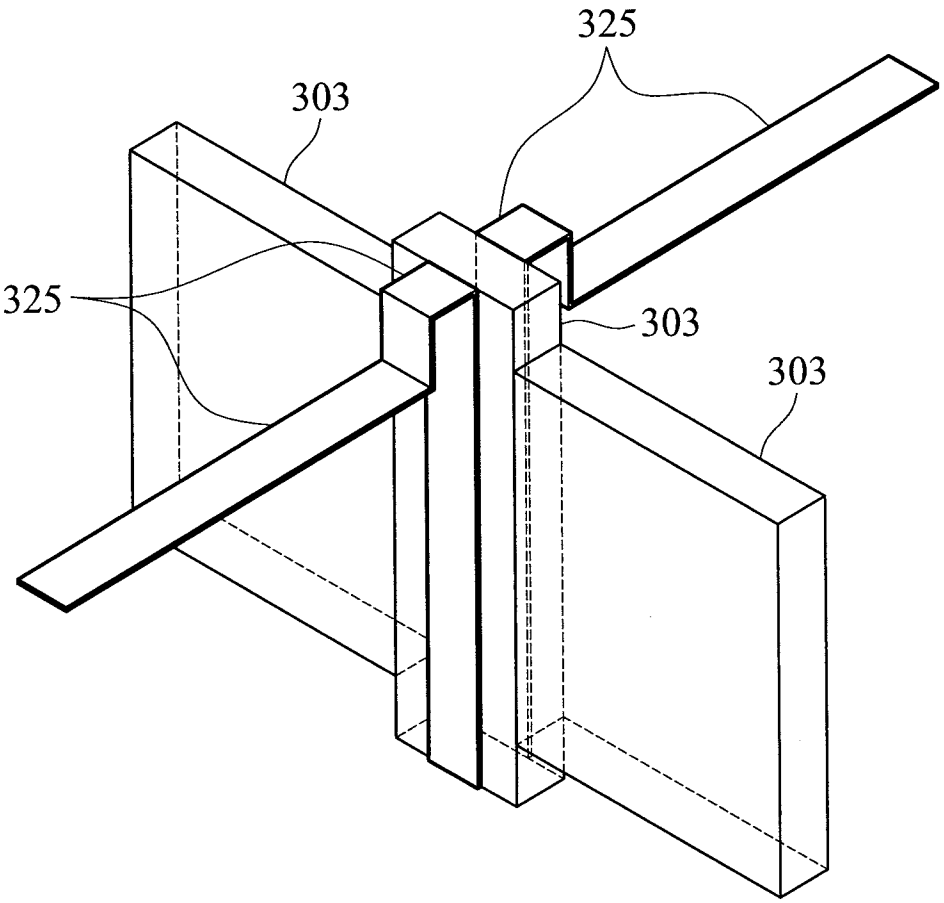
FIG. 3D is a 3D diagram showing the feeding metal element 325 of the dual-band dual-port antenna structure 3 according to another embodiment of the present disclosure.

FIG. 3A, FIG. 3B, FIG. 3C and FIG. 3D are schematic diagrams of a dual-band dual-port antenna structure 3 according to an embodiment of the present disclosure. FIG. 3A is a top-view diagram showing the dual-band dual-port antenna structure 3, FIG. 3B is a side-view diagram showing the dual-band dual-port antenna structure 3, FIG. 3C is a 3D diagram showing the dual-band dual-port antenna structure 3, and FIG. 3D is a 3D diagram showing the feeding metal element 325 of the dual-band dual-port antenna structure 3.

As shown in FIG. 3A and FIG. 3B, the dual-band dual-port antenna structure 3 of the present embodiment includes a first antenna structure 32 and a second antenna structure 33. The first antenna structure 32 is operated in a high-frequency band and the second antenna structure 33 is operated in a low-frequency band. The first antenna structure 32 includes a first radiating element 323 disposed on a first plane, a first feeding port 321 and a first feeding path 320 disposed on a second plane, wherein the first plane and the second plane are not coplanar. The second antenna structure 33 includes a second radiating element 333 disposed on the first plane, a second feeding port 231 and a second feeding path 330 disposed on the second plane. The first feeding path 320 includes a first feeding line 322 and a capacitor 324 and the second feeding path 330 includes a second feeding line 332. The first feeding port 321 and the second feeding port 331 are respectively connected to the first feeding path 320 and the second feeding path 330 such that signals received from the first feeding port 321 and the second feeding port 331 are respectively fed into the first radiating element 323 and the second radiating element 333 through the first feeding path 320 and the second feeding path 330.

As shown in FIG. 3C and FIG. 3D, the dual-band dual-port antenna structure 3 further includes a substrate 30 and a ground plane 21. The substrate 30 includes a first substrate 301, a second substrate 302 and a third substrate 303. The first radiating element 323 and the second radiating element 333 are disposed on the front side 301A (which faces +Z direction of the first plane) of the first substrate 301. The ground plane 31 is disposed on the front side (which faces +Z direction) 302A of the second substrate 302 and electrically connected to ground. The first feeding path 320 and the second feeding path 330 are disposed on the reverse side 302B (which faces −Z direction of the second plane) of the second substrate 302. The first substrate 301 is parallel to the second substrate 302. The third substrate 303 is disposed between the first substrate 301 and the second substrate 302 through the front/reverse side of the third substrate 303 being vertical to the front sides of the first substrate 301 and the second substrate 302. The first to third substrates 301~303 can be FR4 (Flame Retardant 4) substrates.

In the embodiment of the present invention, the dual-band dual-port antenna structure 3 is designed in a space of length L, width W and thickness T with 100 mm, 50 mm and 5 mm, wherein the length L and the width W of the first substrate 301 and the second substrate 302 are both 100 mm and 50 mm. The first antenna structure 32 is the UWB antenna and the second antenna structure 33 is the UHF antenna. The first antenna structure 32 and the second antenna structure 33 both have a perpendicular polarization orientation. The high-frequency band is substantially from 3 GHz to 5 GHz, and the low-frequency band is substantially from 850 MHz to 950 MHz.

In the embodiment of the present invention, the first feeding port 321 and the second feeding port 331 are respectively disposed at two sides of the second substrate 302 such that the dual-band dual-port antenna structure 3 is symmetrical to a straight line L3 between the first feeding port 321 and the second feeding port 331. More specifically, the first feeding path 320 and the second feeding path 330 are separately disposed along the straight line L3, the shape of the first radiating element 323 and the shape of the second radiating element 333 are respectively symmetrical to the straight line L3, and the first feeding port 321 and the second feeding port 331 are respectively disposed on two opposite ends of the straight line L3. The second radiating element 333 of the second antenna structure 33 can entirely surround the first radiating element 323 or partially surround the first radiating element 323. In this embodiment, the second radiating element 333 partially surrounds the first radiating element 323 of the first antenna structure 32.

In the embodiment of the present invention, the first feeding path 320 including the first feeding line 322 and the capacitor 324 is disposed between the first feeding port 321 and the first radiating element 323 and disposed on the reverse side 302B of the second substrate 302. More specifically, the first feeding line 322 has a first feeding portion 3221 and a second feeding portion 3222, the first capacitor 324 is electrically connected between the first feeding portion 3221 and the second feeding portion 3222, and the first feeding portion 3221 is electrically connected between the first feeding port 321 and the first capacitor 324. In this embodiment, the capacitor 324 of the first antenna structure 32 is the SMD.

In the embodiment of the present invention, the first radiating element 323 includes a first radiation branch 3231 and a second radiation branch 3232. The first radiation branch 3231 of the first radiating element 323 is located in the second radiating element 333 of the second antenna structure 33. The first radiation branch 3231 and the second radiation branch 3232 of the first radiating element 323 both have an elliptical shape. The shape and size of the first radiation branch 3231 of the first radiating element 323 is identical to the shape and size of the second radiation branch 3232 of the first radiating element 323, wherein a major axis D of the first radiation branch 3231 of the first radiating element 323 is about 41.6 mm and a minor axis $D_1$ of the first radiation branch 3231 of the first radiating element 323 is about 26 mm. The first radiation branch 3231 has an aperture 3233 and the second radiation branch 3232 has an aperture 3234. The aperture 3233 and the aperture 3234 both have an elliptical shape, wherein major axes $D_2$ of the apertures 3233 and 3234 are about 11.4 mm and minor axes $D_2$ of the apertures 3233 and 3234 are about 5.1 mm. The minor axis of the first radiation branch 3231, the minor axis of the second radiation branch 3232 and the major axes of the apertures 3233 and 3234 are all parallel to the straight line L3 between the first feeding port 321 and the second feeding port 331.

In the embodiment of the present invention, the first antenna structure 32 further includes a feeding metal element 325. The feeding metal element 325 is electrically connected to the second feeding portion 3222. The feeding metal element 325 is the feeding strip; but the present disclosure is not limited thereto. The feeding metal element 325 is located in the apertures 3233 and 3234 of the first radiating element 323. As shown in FIG. 3C and FIG. 3D, the feeding metal element 325 extends, from the front side 302A of the second substrate 302, upwardly into the apertures 3233 and 3234 of the first radiating element 323.

In the embodiment of the present invention, the second antenna structure 33 further includes a first inductor 334 and a second inductor 335 and the second radiating element 333 of the second antenna structure 33 includes a first L-shape radiation branch 3331 and a second L-shape radiation branch 3332. The first inductor 334 is disposed in the first L-shape radiation branch 3331 and the second inductor 335 is disposed in the second L-shape radiation branch 3332. For the first L-shape radiation branch 3331 of the second radiating element 333, the strongest high-frequency current occurs in the area that is closest to the first radiating element 323. Similarly, for the second L-shape radiation branch 3332, the strongest high-frequency current also occurs in the area that is closest to the first radiating element 323. Accordingly, in this embodiment, the first inductor 334 is disposed in the region of the first L-shape radiation branch 3331 of the second radiating element 333 which is closest to the first radiating element 323, and the second inductor 335 is disposed in a region of the second L-shape radiation branch 3332 of the second radiating element 333 which is closest to the first radiating element 323. In other words, the first inductor 334 and the second inductor 335 are disposed in the regions which have the strongest mutual coupling effect between the first radiating element 323 and the second radiating element 333. Hence, the mutual coupling between the first antenna structure 32 and the second antenna structure 33 is reduced through the selected configuration locations.

In detail, the X-direction width $T_2$ of the second inductor 335 disposed in the second L-shape radiation branch 3332 is about 1 mm such that the arm of the second L-shape radiation branch 3332 is divided into two segments with length $L_1$ (about 6.2 mm) and length $L_2$ (about 29.5 mm). The Y-direction widths $W_1$ of arms of the first L-shape radiation branch 3331 and the second L-shape radiation branch 3332 are both about 2.5 mm. The Y-direction width $W_2$ of a junction of the second radiating element 333 and the second feeding line 332 is about 5 mm. The X-direction length parameters T and $T_1$ are about 1 mm. But the present disclosure is not limited thereto. In this embodiment, the first inductor 334 and the second inductor 335 are both the SMDs. The sizes of the SMDs are far less than the space of the dual-band dual-port antenna structure 3. Accordingly, it is not required to increase the design space of the dual-band dual-port antenna structure 3 for disposing the capacitor 324, the first inductor 334 and the second inductor 335.

In the embodiment of the present invention, the second radiating element 333 further includes a shorting portion 3333. The shorting portion 3333 is electrically connected to ground 31. The shorting portion 3333 is a shorting pin; but the present disclosure is not limited thereto.

Figure 4A:
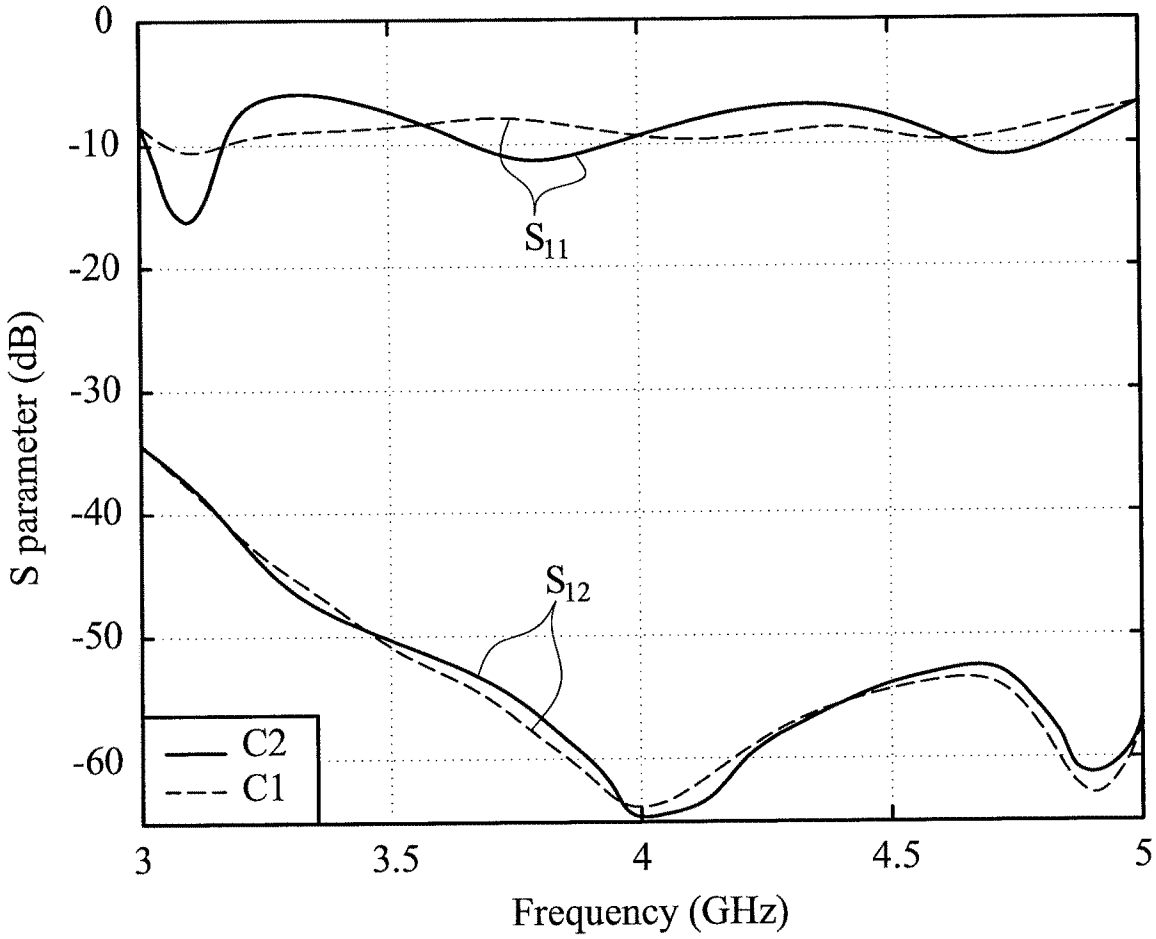
FIG. 4A is a diagram of antenna performance of the first antenna structure 22 of the dual-band dual-port antenna structure 2 according to an embodiment of the invention.
Figure 4B:
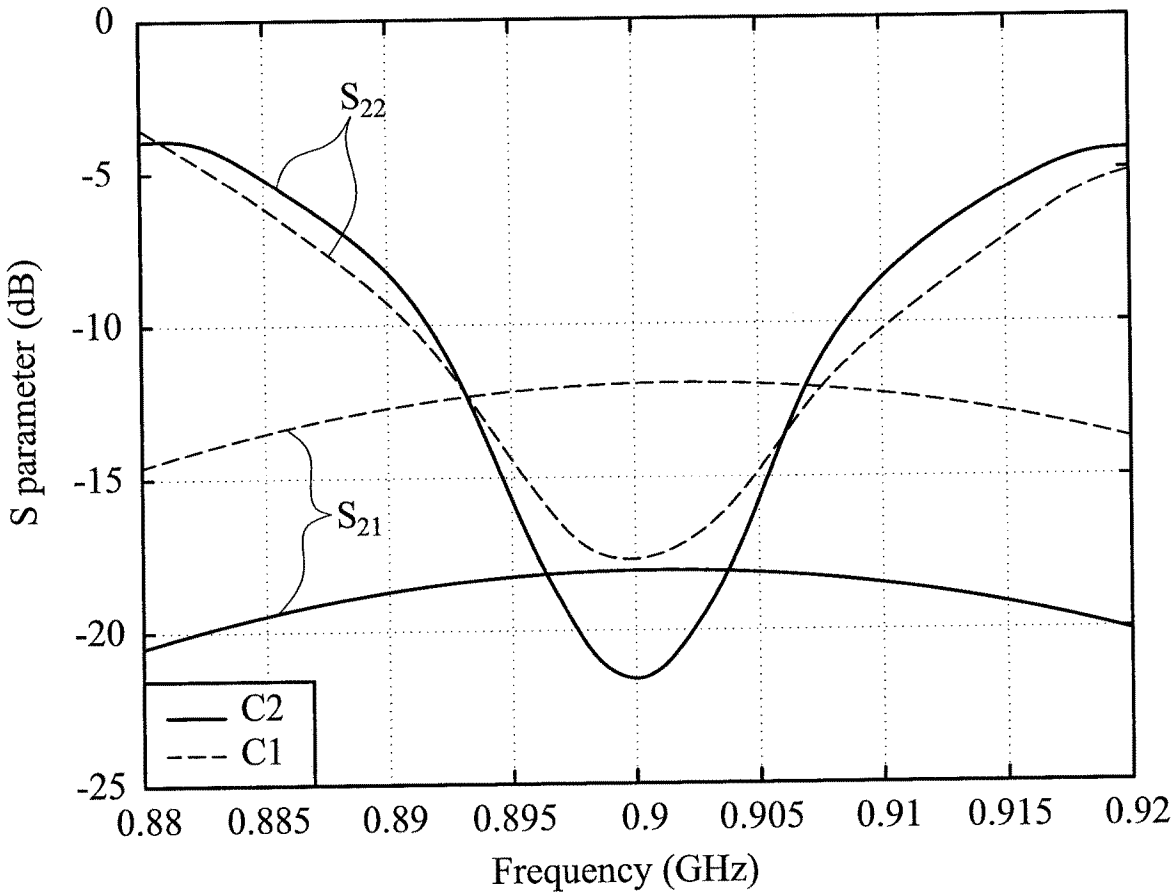
FIG. 4B is a diagram of antenna performance of the second antenna structure 23 of the dual-band dual-port antenna structure 2 according to an embodiment of the invention.

FIG. 4A is a diagram of antenna S-parameters of the first antenna structure 22 of the dual-band dual-port antenna structure 2 according to an embodiment of the invention. FIG. 4B is a diagram of antenna S-parameters of the second antenna structure 23 of the dual-band dual-port antenna structure 2 according to an embodiment of the invention. In FIG. 4A and FIG. 4B, S parameter measurement results of the dual-band dual-port antenna structure 2 without disposing the capacitor 224 and the inductor 234 are represented as dotted lines C1, and S parameter measurement results of the dual-band dual-port antenna structure 2 without disposing the inductor 234 (or with only disposing the capacitor 224) are represented as solid lines C2.

In FIG. 4A and FIG. 4B, the capacitance of the capacitor 224 of the dual-band dual-port antenna structure 2 is selected as 2 pF, wherein reactance of the capacitor 224 with different operation frequencies are represented in Table 3 shown below:

TABLE 3

| | when the capacitance of the capacitor 224 is selected as 2 pF | | | |
|---|---|---|---|---|
| frequencies | 900 MHz | 3 GHz | 4 GHz | 5 GHz |
| reactance | 88.4 | 26.5 | 19.9 | 15.9 |

In FIG. 4B, in the low-frequency band, the transmission parameter S21 of the second antenna structure 23 is reduced from −12 dB to −18 dB after the capacitor 224 is disposed. Accordingly, disposing the capacitor 224 is useful to reduce the mutual coupling between the first antenna structure 22 and the second antenna structure 23.

Figure 5A:
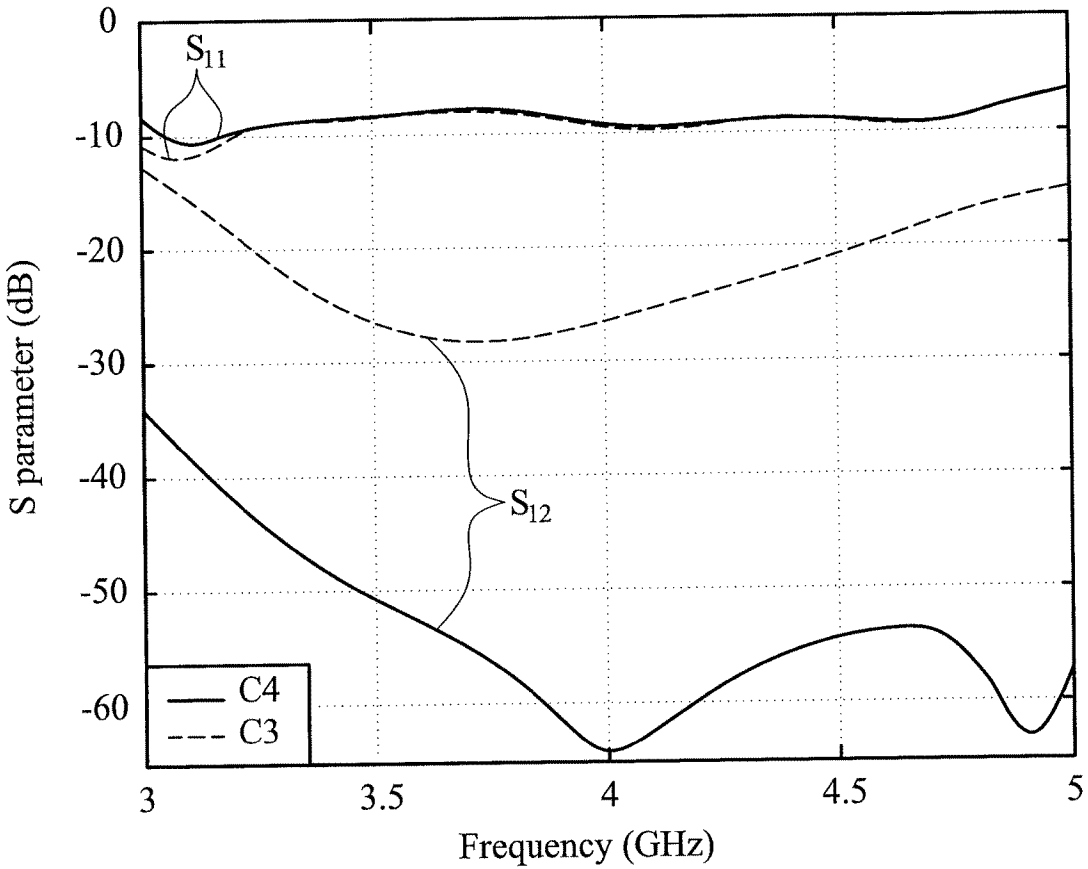
FIG. 5A is a diagram of antenna performance of the first antenna structure 22 of the dual-band dual-port antenna structure 2 according to an embodiment of the invention.
Figure 5B:
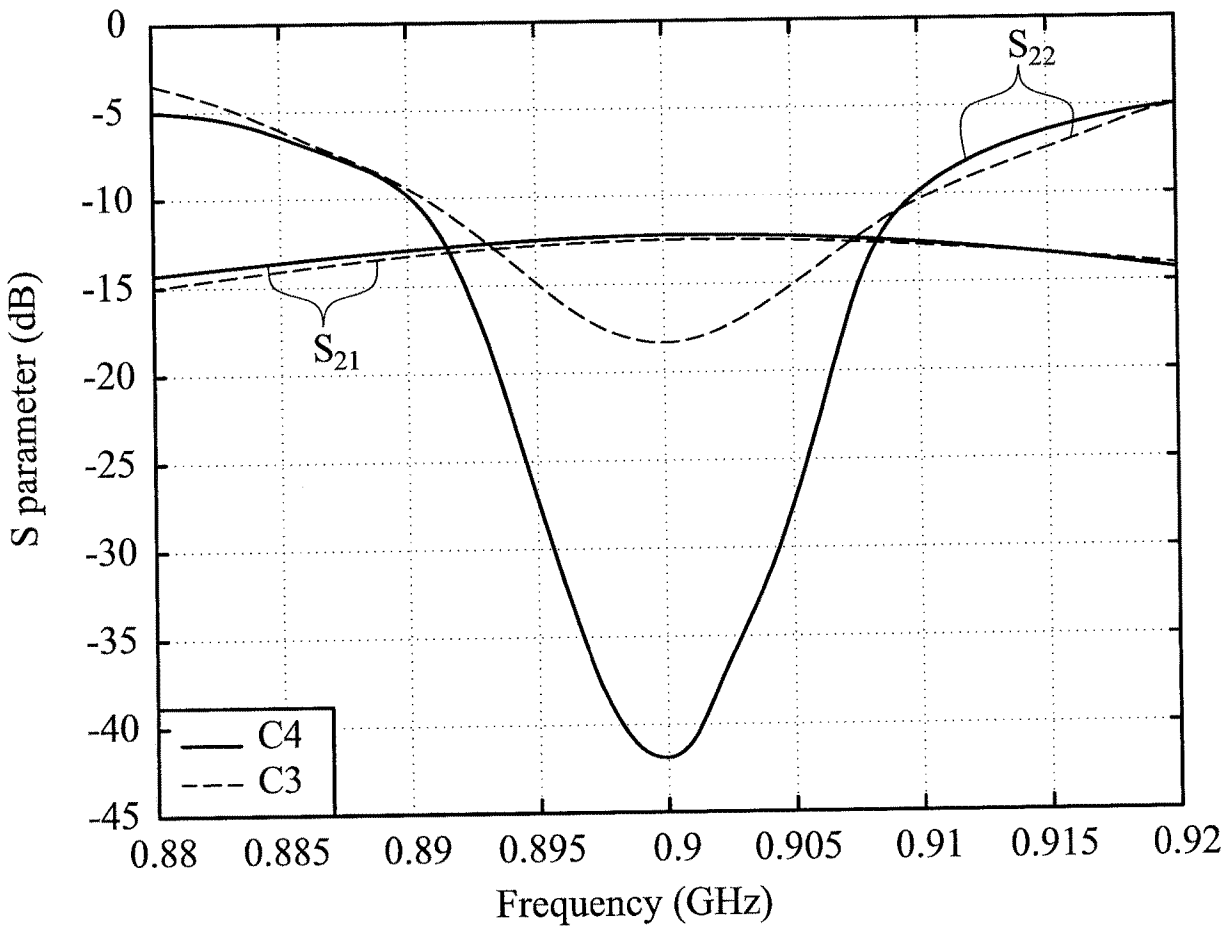
FIG. 5B is a diagram of antenna performance of the second antenna structure 23 of the dual-band dual-port antenna structure 2 according to an embodiment of the invention.

FIG. 5A is a diagram of antenna S-parameters of the first antenna structure 22 of the dual-band dual-port antenna structure 2 according to an embodiment of the invention. FIG. 5B is a diagram of antenna S-parameters of the second antenna structure 23 of the dual-band dual-port antenna structure 2 according to an embodiment of the invention.

In FIG. 5A and FIG. 5B, S parameter measurement results of the dual-band dual-port antenna structure 2 without disposing the capacitor 224 and the inductor 234 are represented as dotted lines C3, and S parameter measurement results of the dual-band dual-port antenna structure 2 without disposing the capacitor 224 (or only disposing the inductor 234) are represented as solid lines C4.

In FIG. 5A and FIG. 5B, the inductance of the inductor 234 of the dual-band dual-port antenna structure 2 is selected as 6 nH, wherein reactance of the inductor 234 with different operation frequencies are represented in Table 4 shown below:

TABLE 4

| | when the capacitance of the inductor 234 is selected as 6 nH | | | |
|---|---|---|---|---|
| frequencies | 900 MHz | 3 GHz | 4 GHz | 5 GHz |
| reactance | 33.9 | 113.1 | 150.8 | 188.5 |

In FIG. 5A, in the high-frequency band, the transmission parameter S12 of the first antenna structure 22 is reduced about 30 dB after disposing the inductor 234. Accordingly, disposing the inductor 234 is useful to reduce the mutual coupling between the first antenna structure 22 and the second antenna structure 23.

Figure 6:
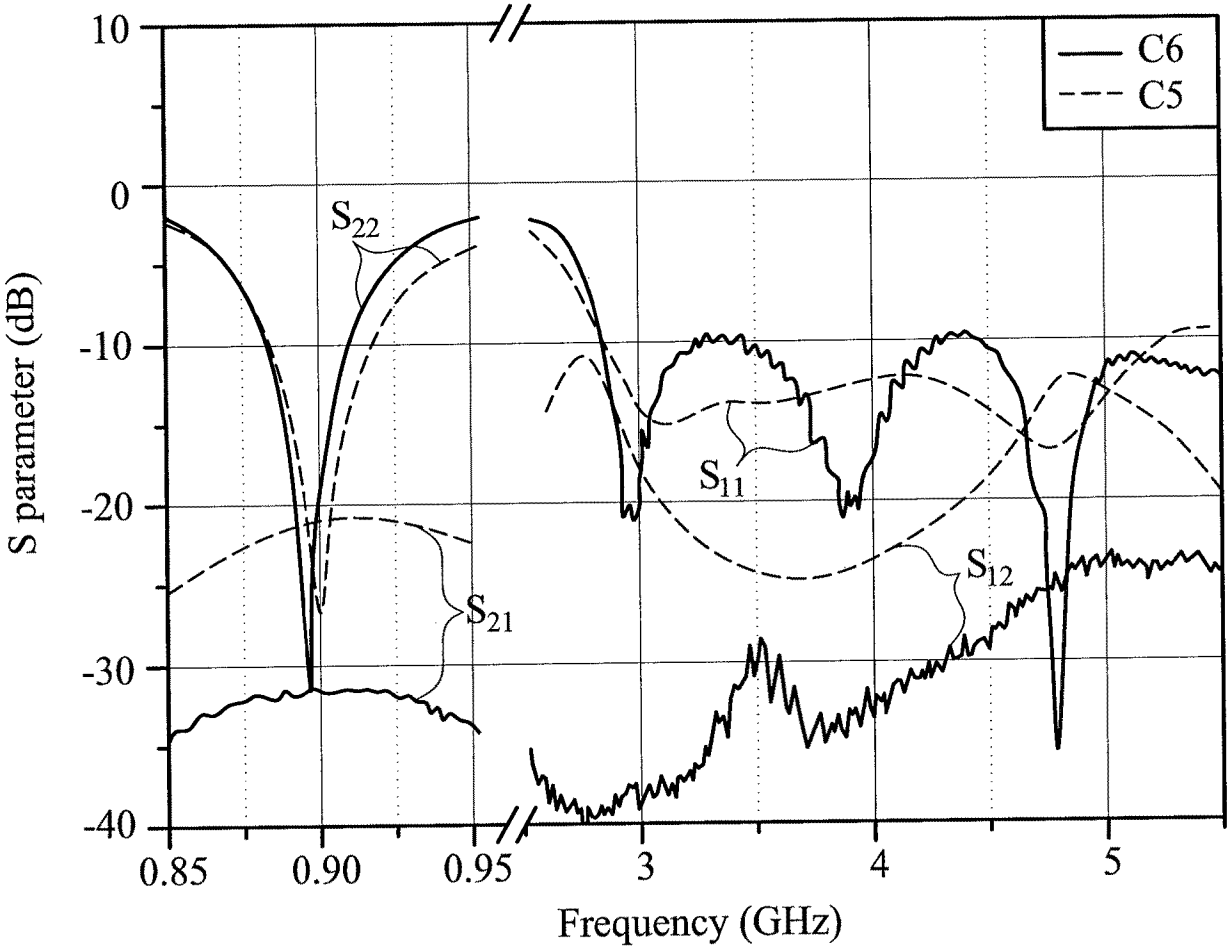
FIG. 6 is a diagram of antenna performance of the dual-band dual-port antenna structure 3 according to an embodiment of the invention.

FIG. 6 is a diagram of antenna S-parameters of the dual-band dual-port antenna structure 3 according to an embodiment of the invention. In FIG. 6, S parameter measurement results of the dual-band dual-port antenna structure 3 without disposing the capacitor 324, the first inductor 334 and the second inductor 335 are represented as dotted lines C5, and S parameter measurement results of the dual-band dual-port antenna structure 3 with disposing the capacitor 324, the first inductor 334 and the second inductor 335 are represented as solid lines C6. In FIG. 6, the capacitance of the capacitor 324 of the dual-band dual-port antenna structure 3 is selected as 2 pF, an inductance of the first inductor 334 and the second inductor 335 of the dual-band dual-port antenna structure 3 is selected as 9.5 nH, wherein reactance of the capacitor 324, the first inductor 334 and the second inductor 335 with different operation frequencies are represented in Table 5 and Table 6 shown below:

TABLE 5

| | when the capacitance of the capacitor 324 is selected as 2 pF | | | |
|---|---|---|---|---|
| frequencies | 900 MHz | 3 GHz | 4 GHz | 5 GHz |
| reactance | 88.4 | 26.5 | 19.9 | 15.9 |

TABLE 6

| | when the inductance of the inductor 14 is selected as 9.5 nH | | | |
|---|---|---|---|---|
| frequencies | 900 MHz | 3 GHz | 4 GHz | 5 GHz |
| reactance | 53.7 | 113.1 | 150.8 | 188.5 |

In FIG. 6, in the high-frequency band, the transmission parameter S12 of the first antenna structure 32 is reduced to less than −25 dB after disposing the capacitor 324, the first inductor 334 and the second inductor 335. In the low-frequency band, the transmission parameter S21 of the second antenna structure 33 is reduced to less than −30 dB after disposing the capacitor 324, the first inductor 334 and the second inductor 335. Accordingly, disposing the capacitor 324, the first inductor 334 and the second inductor 335 is useful to reduce the mutual coupling between the first antenna structure 22 and the second antenna structure 23.

Note that the above element sizes, element shapes, and frequency ranges are not limitations of the invention. An antenna engineer can adjust these settings or values according to different requirements. It is understood that the multiband switchable antenna structure of the invention are not limited to the configurations of FIGS. 1, 2A, 2B, 3A, 3B, 3C and 3D. The invention may merely include any one or more features of any one or more embodiments of FIGS. 1, 2A, 2B, 3A, 3B, 3C and 3D. In other words, not all of the features shown in the figures should be implemented in the multiband switchable antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with a true scope of the disclosed embodiments being indicated by the following claims and their equivalents.

What is claimed is:

1. A dual-band dual-port antenna structure, comprising:

a first antenna structure and a second antenna structure;

wherein the first antenna structure operates in a high-frequency band and comprises a first feeding port, a first feeding path electrically connected to the first feeding port, and a first radiating element;

the second antenna structure operates in a low-frequency band and comprises a second feeding port, a second feeding path electrically connected to the second feeding port, and a second radiating element;

the first feeding path comprises a first capacitor and a first feeding line;

the second feeding path comprises a first inductor and a second feeding line;

the second radiating element of the second antenna structure at least partially surrounds the first radiating element of the first antenna structure;

wherein the first feeding line has a first feeding portion and a second feeding portion, the first capacitor is electrically connected between the first feeding portion and the second feeding portion, and the first feeding portion is electrically connected between the first feeding port and the first capacitor; and the second feeding line has a third feeding portion and a fourth feeding portion, the first inductor is electrically connected between the third feeding portion and the fourth feeding portion, and the third feeding portion is electrically connected between the second feeding port and the first inductor;

wherein the first radiating element and the second radiating element are disposed on a first plane;

the first capacitor, the first feeding portion, the second feeding portion, the third feeding portion, the fourth feeding portion and the first inductor are disposed on a second plane; and the first plane and the second plane are not coplanar.

2. The dual-band dual-port antenna structure of claim 1, wherein the first antenna structure further comprises a feeding metal element electrically connected to the second feeding portion; and the first radiating element has an aperture in the center of the first radiating element and the feeding metal element is located in the aperture of the first radiating element.

3. The dual-band dual-port antenna structure of claim 2, further comprising a ground plane disposed on a third plane, wherein the third plane is located between the first plane and the second plane, and the second radiating element further comprises a shorting pin electrically connected to the ground plane.

4. The dual-band dual-port antenna structure of claim 1, wherein the second radiating element substantially has a U-shape and an opening of the U-shape faces the second feeding port.

5. The dual-band dual-port antenna structure of claim 1, wherein the high-frequency band is substantially from 3 GHz to 5 GHz and the low-frequency band is substantially from 880 MHz to 920 MHz.

6. The dual-band dual-port antenna structure of claim 1, wherein the first feeding path and the second feeding path are separately disposed along a straight line, a shape of the first radiating element and a shape of the second radiating element are respectively symmetrical to the straight line, and the first feeding port and the second feeding port are respectively disposed on two opposite ends of the straight line.

7. The dual-band dual-port antenna structure of claim 1, wherein the second radiating element of the second antenna structure entirely surrounds the first radiating element of the first antenna structure.

8. The dual-band dual-port antenna structure of claim 1, wherein the second radiating element substantially has a U-shape, and an area inside an opening of the U-shape where the first radiating element is located is larger than an area outside the opening of the U-shape where the first radiating element is located.

9. A dual-band dual-port antenna structure, comprising:

a first antenna structure and a second antenna structure;

wherein the first antenna structure operates in a high-frequency band and comprises a first feeding port, a first feeding path electrically connected to the first feeding port, and a first radiating element;

the second antenna structure operates in a low-frequency band and comprises a second feeding port, a second feeding path electrically connected to the second feeding port, and a second radiating element;

the first feeding path comprises a first capacitor and a first feeding line;

the second radiating element comprises a first radiation branch and a second radiation branch;

the first radiation branch comprises a first inductor and the second radiation branch comprises a second inductor; and the second radiating element of the second antenna structure at least partially surrounds the first radiating element of the first antenna structure;

wherein the first feeding line has a first feeding portion and a second feeding portion, the first capacitor is electrically connected between the first feeding portion and the second feeding portion, and the first feeding portion is electrically connected between the first feeding port and the first capacitor;

wherein the first radiating element and the second radiating element are disposed on a first plane;

the first capacitor, the first feeding portion and the second feeding portion are disposed on a second plane; and the first plane and the second plane are not coplanar.

10. The dual-band dual-port antenna structure of claim 9, wherein the first antenna structure further comprises a feeding metal element electrically connected to the second feeding portion;

the first radiating element comprises a first radiation branch and a second radiation branch, and the first radiation branch of the first radiating element and the second radiation branch of the first radiating element each have an aperture; and the feeding metal element extends, from the second plane, upwardly into the two apertures of the first radiation branch and the second radiation branch.

11. The dual-band dual-port antenna structure of 9, further comprising a ground plane disposed on a third plane, wherein the third plane is located between the first plane and the second plane, and the second radiating element further comprises a shorting pin electrically connected to the ground plane.

12. The dual-band dual-port antenna structure of claim 9, wherein an opening of the second radiating element faces the second feeding port.

13. The dual-band dual-port antenna structure of claim 9, wherein the high-frequency band is substantially from 3 GHz to 5 GHz and the low-frequency band is substantially from 850 MHz to 950 MHz.

14. The dual-band dual-port antenna structure of claim 9, wherein the first feeding path and the second feeding path are separately disposed along a straight line, a shape of the first radiating element and a shape of the second radiating element are respectively symmetrical to the straight line, and the first feeding port and the second feeding port are respectively disposed on two opposite ends of the straight line.

15. The dual-band dual-port antenna structure of claim 9, wherein the first radiation branch of the first radiating element of the first antenna structure is located in the second radiating element of the second antenna structure.

16. The dual-band dual-port antenna structure of claim 9, wherein the first inductor is disposed in a region of the first radiation branch of the second radiating element which is closest to the first radiating element, and the second inductor is disposed in a region of the second radiation branch of the second radiating element which is closest to the first radiating element; and the first radiation branch of the second radiating element and the second radiation branch of the second radiating element substantially and respectively have a L-shape.

* * * * *